US005730625A

United States Patent [19]

Sikora

[11] Patent Number: 5,730,625

[45] Date of Patent: Mar. 24, 1998

[54] ELECTRICAL CONNECTION FOR MOTOR VEHICLES

[75] Inventor: Andreas Sikora, Hagen, Germany

[73] Assignee: Delphi Automotive Systems Deutschland, Wuppertal, Germany

[21] Appl. No.: 578,635

[22] PCT Filed: May 12, 1995

[86] PCT No.: PCT/DE95/00630

§ 371 Date: Apr. 1, 1996

§ 102(e) Date: Apr. 1, 1996

[87] PCT Pub. No.: WO95/32531

PCT Pub. Date: Nov. 30, 1995

[30] Foreign Application Priority Data

May 21, 1994 [DE] Germany ..... 44 18 004.7

[51] Int. Cl.[6] ..... H01R 13/40

[52] U.S. Cl. ..... 439/595; 439/271

[58] Field of Search ..... 439/271, 275, 439/595, 680, 744

[56] References Cited

U.S. PATENT DOCUMENTS

| | | | |
|---|---|---|---|
| 4,826,452 | 5/1989 | Sian et al. | 439/595 |
| 5,071,369 | 12/1991 | Denlinger et al. | 439/595 |
| 5,127,854 | 7/1992 | Fujitani et al. | 439/595 |
| 5,484,301 | 1/1996 | Koumatsu et al. | 439/271 |
| 5,628,652 | 5/1997 | Ohsumi | 439/595 |

FOREIGN PATENT DOCUMENTS

| | | |
|---|---|---|
| 0330436 | 8/1989 | European Pat. Off. . |
| 2684242 | 5/1993 | France . |
| 4420546 | 12/1994 | Germany . |

*Primary Examiner*—Neil Abrams
*Assistant Examiner*—Katrina Davis
*Attorney, Agent, or Firm*—Cary W. Brooks

[57] ABSTRACT

The electrical connection comprises a male part and a female part. The female part comprises a receptacle for the insertion profile of the male part, in which at least one contact pin is located. During coupling, the contact pin moves axially into the male part and is made contact with there by a contact sleeve assigned to it. The male part comprises a housing having at least one tubular channel for the contact sleeve, and an end plate, which has at least one through-hole, for the contact pin of the female part. This end plate is displaceable with respect to the housing between two axial positions, for which purpose longitudinal guide elements are provided, namely between an extended position and a pushed-in position. In the extended position, axial insertion assembly of the contact sleeve in the housing is possible until a sprung tongue, which is integrally formed on the housing, snaps behind a shoulder on the contact sleeve which is fitted in a defined assembly position. In the pushed-in position, a longitudinal guide element which is located on the end plate passes into the spring path of the tongue and locks the contact sleeve in its assembly position.

8 Claims, 7 Drawing Sheets

ELECTRICAL CONNECTION FOR MOTOR VEHICLES

FIELD OF THE INVENTION

The invention relates to an electrical connection of the type specified in the preamble of claim 1. In particular in the case of motor vehicles, cable harnesses are used whose male parts and female parts have a plurality of contact pins and contact sleeves respectively located side by side.

BACKGROUND OF THE INVENTION

In the case of the known connection of this type, the longitudinal guide elements between the end plate and the housing comprised guide pins projecting from the end plate which were displaceable in axial guide chambers in the housing. These guide chambers were produced by a raised area in the housing, above each tubular channel, which was used for insertion assembly of a contact sleeve. This resulted in the male part having a relatively large physical height. The sprung tongue was integrally formed in the housing interior on the inner surface of the tubular channel and did not allow any visual inspection of whether the contact sleeve insertion assembly was correct. Defects could arise during assembly of the components. The assembly of these components of the known male part was cumbersome and, above all, unsuitable for automation.

SUMMARY OF THE INVENTION

The invention is based on the object of developing a reliable electrical connection of the type stated in the preamble of claim 1, whose components can be assembled conveniently and are suitable for automation of the process. This is achieved according to the invention by the measures outlined in the descriptive part of claim 1, which have the following particular significance.

Special longitudinal guide elements between the end plate and the housing are avoided because the outer contour of the housing simply itself carries out the guide functions during longitudinal displacement of the cap. The assembly of the cap with the housing can be carried out conveniently without any cumbersome alignment of individual longitudinal guide elements, and the cap just needs to be placed over the housing, like a cover. This allows automatic assembly. The plugged-on cap also ensures the housing is encased and guarantees additional protection. This covering of the housing by the cap allows the sprung tongue to be produced particularly simply, namely by wall parts of the tubular wall of the housing itself. The tongue is thus located in the housing such that it can easily be seen from the outside, and this is also true in the extended position of the cap. It is thus possible to check visually during the insertion assembly of the contact sleeve whether the spring is pivoted about beyond the outer contour of the housing before, finally, in the defined assembly position of the contact sleeve in the housing, the spring is aligned again with the adjacent regions of the housing tubular wall. Incorrect or incomplete insertion assembly of the contact sleeve can be identified by the spring making no pivoting movement or the pivoting movement being inadequate. This can be reliably identified by visual probe means. Automation of the assembly can easily be implemented. After this inspection, the cap can be pushed into the final pushed-in position on the housing, where it covers the tongue and thus prevents the tongue springing out inadvertently. In this covered position, the cap locks the contact sleeve which has been inserted in the correct assembled position in the housing; it is thus used as a locking means for the assembled contact sleeve. On completion, the correct assembled position of all the components is ensured by the final electrical inspection of the complete male part. Incorrect results are prevented.

BRIEF DESCRIPTION OF THE DRAWINGS

Further measures and advantages of the invention result from the subclaims, the following description and the drawings. The invention is illustrated, using an exemplary embodiment, in the drawings, in which:

DESCRIPTION OF THE PREFERRED EMBODIMENTS

Figure 3:
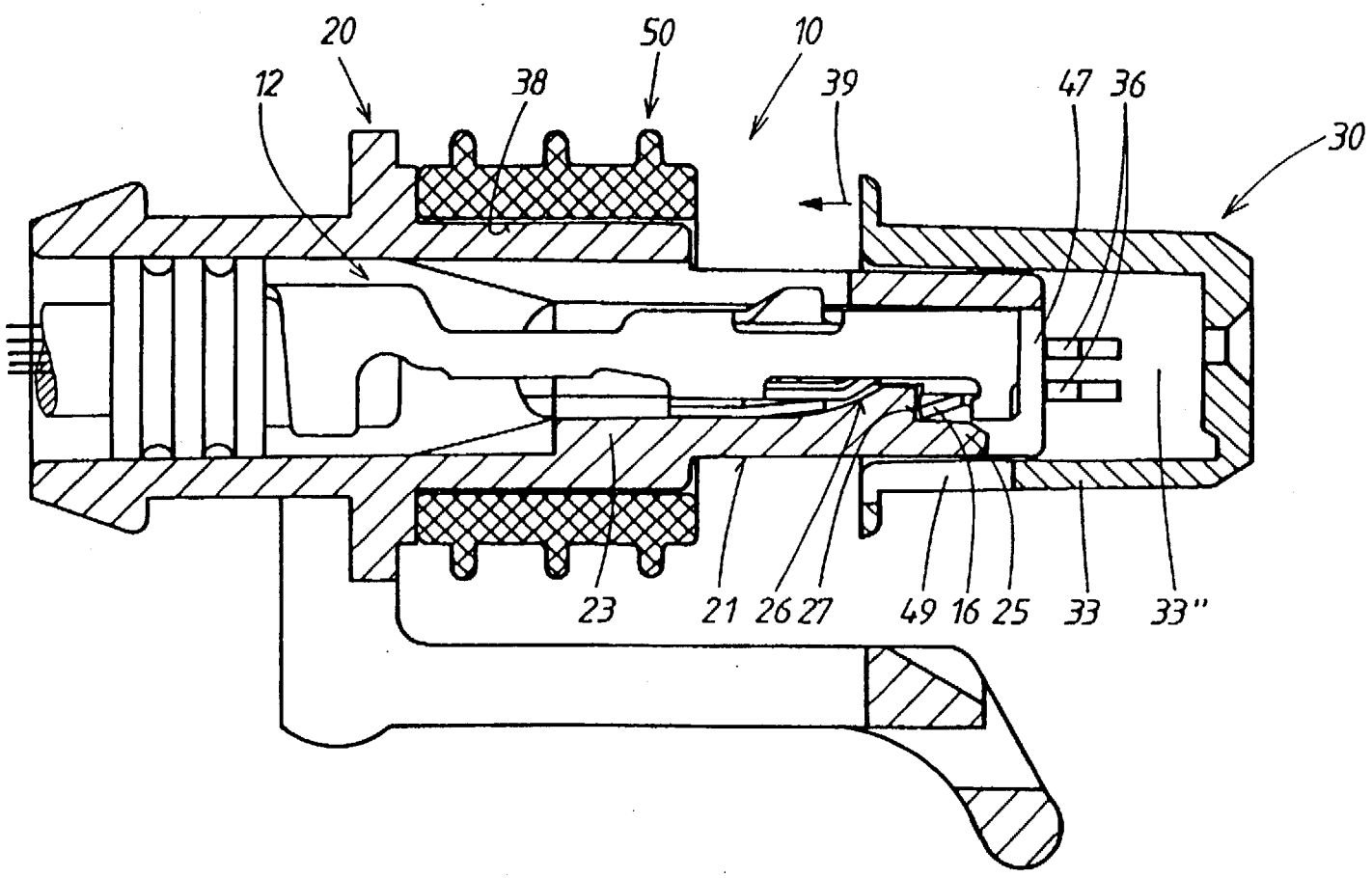
FIG. 3 shows the final, correct assembled position of the contact sleeve, in the preassembled male part, illustrated in a manner corresponding to FIG. 1.
Figure 4:
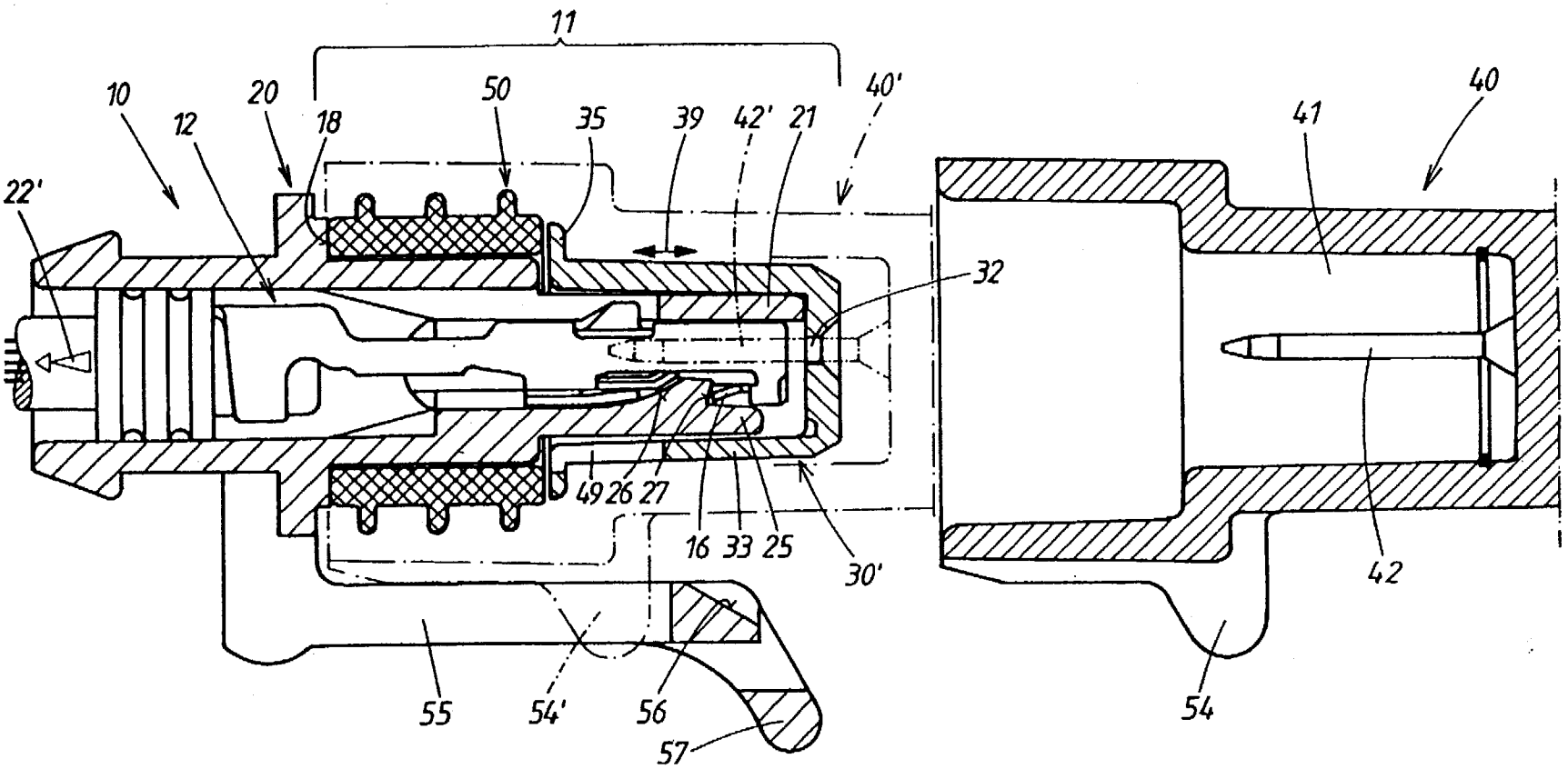
FIG. 4 shows the complete plug in the left-hand half of the figure, after the last assembly phase following that in FIG. 3, and shows the corresponding longitudinal section through the associated female part of the connection according to the invention in the right-hand half of the figure.

As can best be seen in FIG. 4, the electrical connection according to the invention comprises a male part 10 and a female part 40 which can be coupled to one another in use. The decoupled position of these parts 10,40 is illustrated by solid lines in FIG. 4, while the coupled position is illustrated by dashed-dotted lines. The male part 10 has a front section 11 which, when coupled, engages in a receptacle 41 which is complementary to the insertion profile of this section 11. The female part 40 has a contact pin 42 in the receptacle 41, to which contact pin 42 a contact sleeve 12 is assigned in the male part 10. The male part 10 and the female part 40 can have any desired number of contact sleeves 12 and contact pins 42 respectively located side by side, which will be explained in more detail with reference to FIG. 5 but, with respect to FIGS. 1 to 4, it is sufficient to describe the installation of only one such contact sleeve 12. This would correspond to the smallest theoretically possible physical type of such a male part having only one contact sleeve. It is self-evident that the invention is directed at male parts having any desired number of contact sleeves to which female parts 40 of complementary design and having a corresponding number of contact pins 41 are then assigned.

Apart from the number of contact sleeves 12, the male part 10 according to the invention thus comprises a physical unit having four components, namely the already mentioned contact sleeve 12, furthermore a housing 20, an annular seal 35 seated thereon and an end cap 30. These components are mutually locked in their final position which can be seen in FIG. 4, which will be explained in more detail later.

Figure 1:
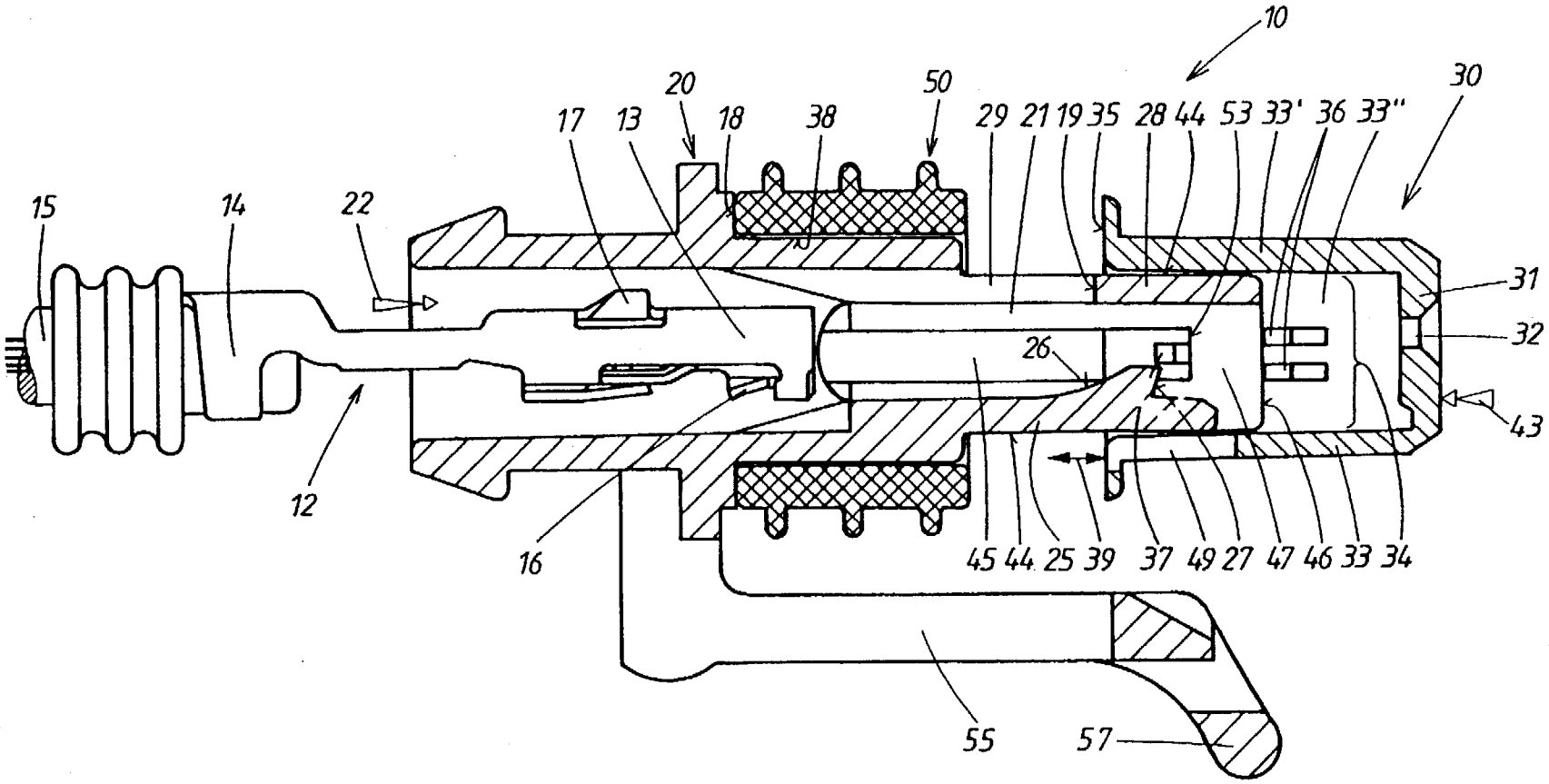
FIG. 1 shows a major enlargement of a longitudinal section of the male part of the connection according to the invention at the start of assembly of a contact sleeve, the section I—I being illustrated in FIG. 5.

The contact sleeve 12 is formed as a stamped and bent product from sheet metal and, as can be seen from FIG. 1, in addition to its basic, sleeve-shaped contact section 13, comprises a connecting section 14 for an electrical conductor 15. The contact section 13 has a shoulder 16 which runs inclined with respect to the longitudinal direction and is used for locking, which will be described in more detail later, of the contact sleeve 12 in the housing 20. Furthermore, the contact section 13 has a tab 17 which projects outward beyond the outline of the sleeve.

Figure 5:
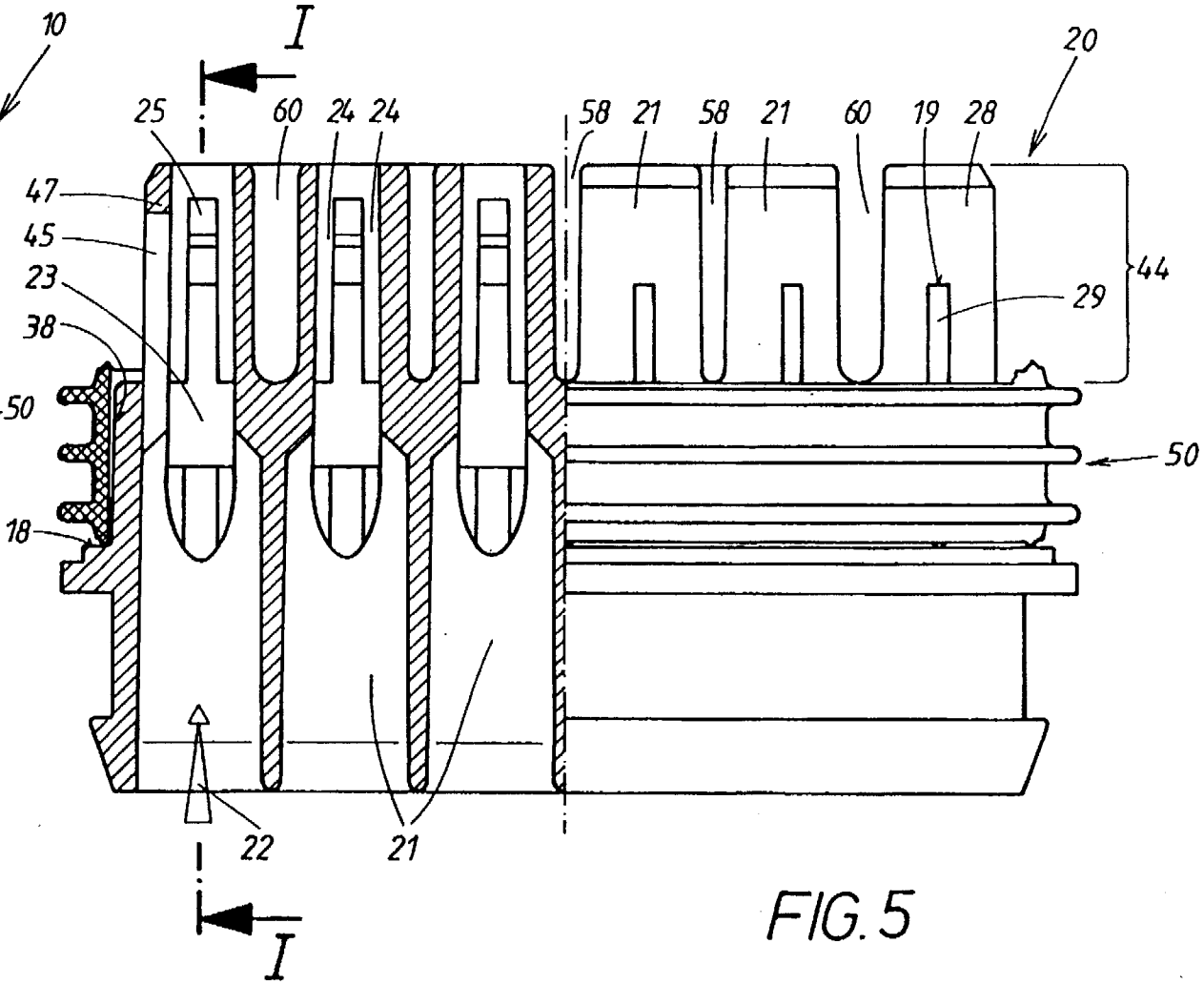
FIG. 5 shows a half section of a first component and a second component of the male part according to the invention, namely a housing having an annular seal.

As can be seen in FIGS. 1 and 5, the housing 20 comprises at least one, but preferably a plurality of tubular channels 21 which each have an offset hole and are used for axial insertion assembly of the associated contact sleeve 12 in the direction of the arrow 22 in FIG. 1. The widened region of the channel 21 has a circular profile and the narrowed outer region has a rectangular profile. Each channel is surrounded by walls which are cohesive with one another in places. A tubular shape is thus produced which can become an individual passageway particularly in the narrowed hole region, according to FIG. 5. It is thus intended to call the channel 21 a "tube" for short in the following text. As can be seen from FIG. 5, a lower tubular wall 23 is provided in its end region with longitudinal gaps 24 between which a tongue 25, which can also be seen in FIG. 1, is then produced, namely from the tubular wall 23 itself. Located on that side of the tongue 25 which faces the tube interior is a rising ramp which ends in a preferably undercut step 27. The opposite, upper tubular wall 28 of the tube 21 has a longitudinal slot 29 which is closed on its side facing the end of the tube 21, that is to say has a closed slot end 19, according to FIG. 5.

The housing 20 is also designed to be stepped on its outside, and of these steps a housing step 18 which is provided in the central housing zone must be emphasized, which forms a stop surface for one end of the already mentioned annular seal 50. The annular seal 50 is made of elastomeric material with circumferential radial ribs on its outside and encloses a circumferential housing zone 38 which can be seen in FIG. 5 and is stepped with respect to the tube 21. As can be seen in FIG. 4, an end flange 35 of the already mentioned cap 30 is used to secure the annular seal 50 on the housing 20. The cap 30 has yet further major functions.

Figure 6:
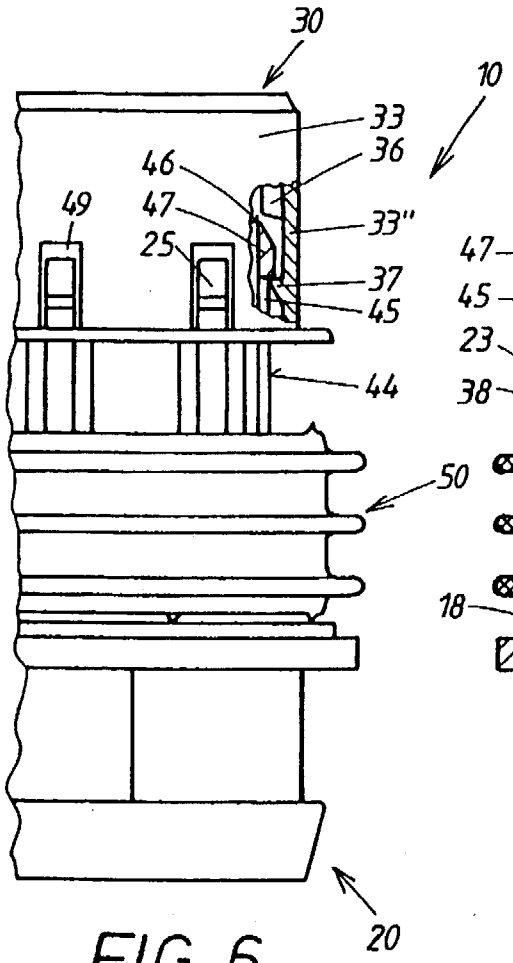
FIG. 6 shows a part of the housing in FIG. 5 on which a further component of the male part, namely a cap, has been plugged.
Figure 7:
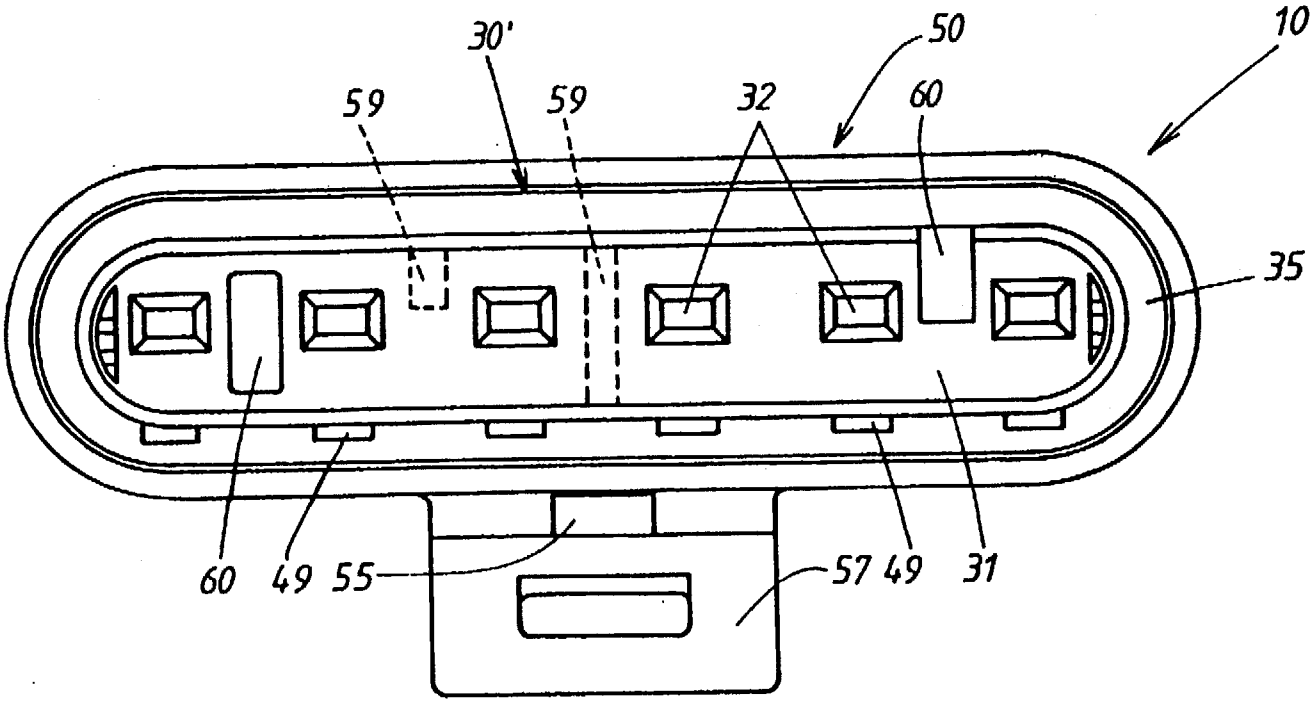
FIG. 7 shows an end view ofthe complete male part according to the invention.
Figure 8:
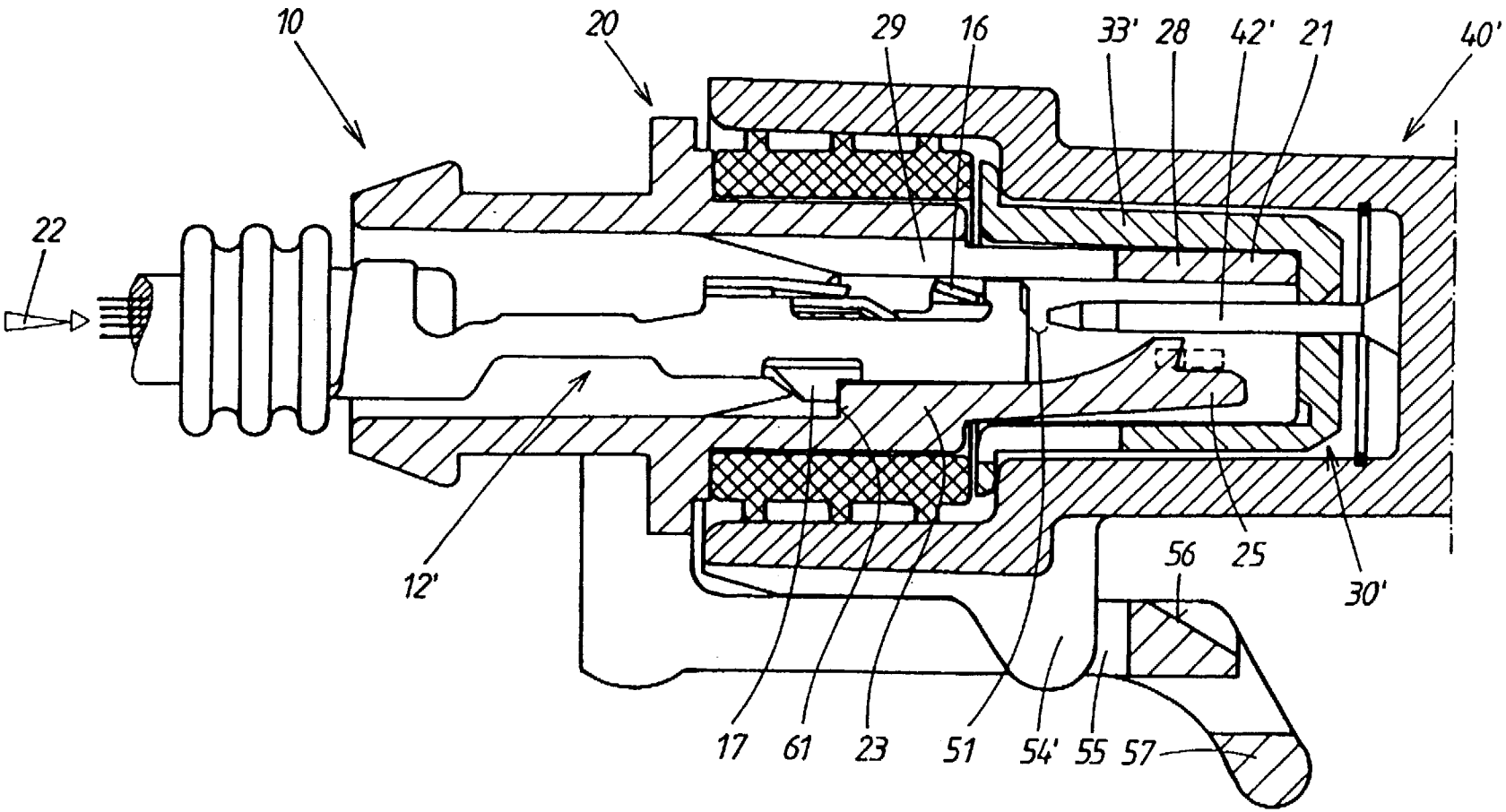
FIG. 8 shows a longitudinal section, corresponding to FIG. 4 of the female and male parts according to the invention, coupled to one another when, in advance, a correct visual inspection has not already been completed in the construction phase in FIG. 2 and the contact sleeve has been installed in the male part incorrectly, namely in a twisted position, which can, however, now still be detected by an electrical final inspection using the live components.

As can be seen in FIGS. 1, 6 and 7, the cap 30 has a U-shaped profile and has an essentially planar, plate-shaped apex wall 31 having at least one through-hole 32. Each of these through-holes 32 is assigned to in each case one tube 21 of the housing 20 and, when coupled, as is shown in dashed lines in FIG. 4 and FIG. 8, is used for the contact pin 42 on the female side to enter the housing interior. The cap 30 has a side wall which is circumferential on all sides but which, because of its different design and the function of individual wall parts, is designated by three reference symbols 33 to 33" in the drawings. A cap interior 34 is produced which is matched to the outer contour 44 of the front section of the housing 20. This housing outer contour 44 is at the same time used as a longitudinal guide element for the cap 30 in order to move said cap 30 between two defined axial positions 30',30', one 30' of which is shown in FIGS. 1 to 3 and 6 and the other 30' is shown in FIGS. 4 and 8. The cap 30 is guided in a longitudinally displaceable manner on the outer contour 44 of the housing 20 in the direction of the double arrows 39 shown in FIGS. 1 and 4. These two axial positions 30',30' are expediently secured by latching holders which are advantageously designed in the following manner.

The tubular wall, which acts as a lateral boundary of the housing, on which the parallel section for FIG. 1 is made on the section line I—I in FIG. 5 has a longitudinal cutout 45 which is bounded towards the end 46 of the tube 21 by an end web 47. As can be seen in FIGS. 1 and 6, the associated side wall part 33" of the cap 30 has on its inner surface latching projections 36,37 which are axially offset with respect to one another and grip the end web 47 of the housing between them in the one axial position 30' of the cap. The latching projections 36,37 are provided with suitable lead-in profiles. In this position 30', the cap is located at a distance from the annular seal 50, for which reason this position is intended to be designated the "extended position 30" for short in the following text. In the other axial position 30', in contrast, according to FIG. 4, the end flange 34 of the cap, as has already been described, holds the annular seal 50 firmly in the position pressed against the housing step 18, for which reason this position 30' is intended to be designated the "pushed-in position" for short in the following text.

As is intended to be explained with reference to FIG. 1, the assembly of the male part 10 according to the invention is carried out in a plurality of steps. Firstly, the already described annular seal 50 is fitted onto the housing 20. The cap is then plugged axially onto the free tube end of the housing 20 in the direction of the insertion arrow 43 in FIG. 4. A longitudinal displacement 39 is carried out until the first latching projection 37 snaps behind the end web 47, while the second latching projections 36, of which two are provided here, come to rest in front of the end 46 of the housing tube 21. As has already been mentioned, this defines the extended position 30 of the cap. The cap 30 is in this case connected to the housing 20 in a captive manner and can be supplied as a physical unit in this preassembled position.

Figure 2:
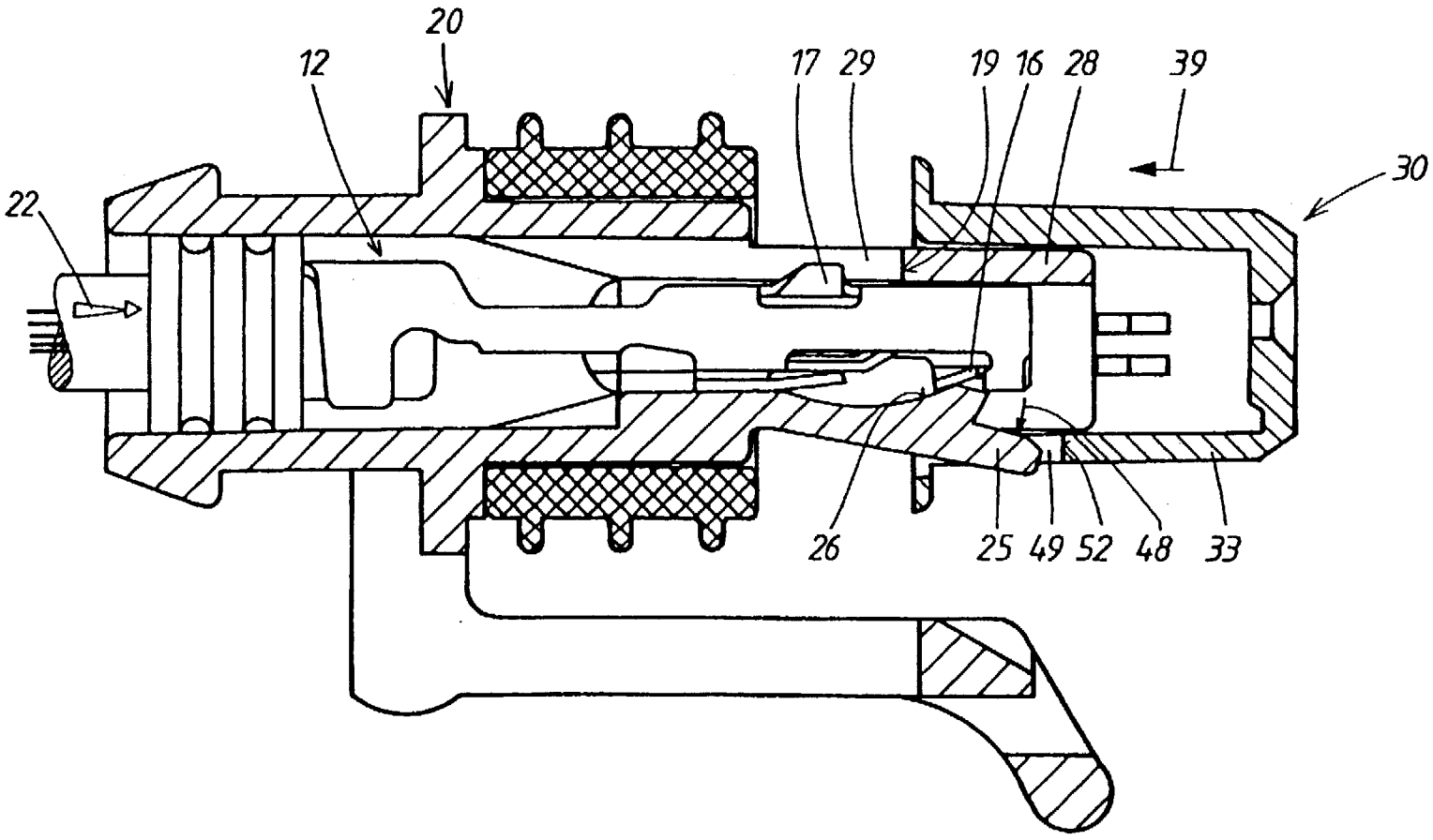
FIG. 2 shows a later phase of contact sleeve assembly, illustrated in a corresponding manner to FIG. 1.

The already mentioned insertion assembly 22 of the contact sleeve 12, which is connected to an electrical conductor 15, now takes place according to FIG. 1. As the actual insertion 22 takes place, the shoulder 16 moves onto the ramp 26 of the tongue 25 and the tongue 25 pivots outward radially, as can be seen in FIG. 2. This is possible although the lower side wall part 33 of the cap is located in its extended position 30" at this point, because a window 49 is provided there. As can be seen in FIG. 2, the free end of the tongue 25 enters the window 49, which can be confirmed unambiguously visually or by optical probe means. At the same time, the tab 17 which projects radially on the contact sleeve 12 enters the said longitudinal slot 29, which has a closed slot end 51 in this tubular wall 28. This slot end 51 can form a stop for the tab 17. The movement into the slot 29 secures the contact sleeve 12 in the housing in a position such that it cannot rotate.

As long as no defined, final assembled position of the contact sleeve 12 in the interior of the housing 20 has been reached, the cap cannot yet be pushed from its extended position 30" in FIG. 2 into its final pushed-in position 30' in FIG. 4 specifically, in this case, the free end of the tongue 25 would abut against the window inner face 52 in the side wall part 33 of the cap. The pushing-on 39 is initially blocked. The final assembled position according to FIG. 3 cannot be reached until the shoulder 16 has moved as far as the axial region of the undercut step 27 of the ramp 26 and the tongue 25, by virtue of the spring stress of the plastic material within it, snaps back again into its original position, where it is axially aligned with the lower tubular wall 23. The free end of the tongue 25 has then, according to FIG. 3, moved out of the window 49 of the side wall part 33 of the cap. The cap can now be pushed from its extended position 30 in FIG. 3 further in the direction of the displacement arrow 39, against the housing zone 38 which is provided with the annular seal 50. At the same time, the front latching projections 36 move from the side wall region 33' of the cap over the end web 47 of the cap side wall part 33' and come to rest in the interior of the longitudinal cutout 45, which can be seen in FIG. 1, on the inner web edge 53 which can be seen there. In the pushed-in position 30', those side wall parts 33 of the cap which are located beyond the window 49 are located above the free end of the tongue 25. The tongue end is covered by the cap side wall part 33 for which reason radial pivoting 48 of the cap 30' in the direction of the arrow in FIG. 2 is then prevented. In the pushed-in position 30', the cap engages on all sides around the outer contour 44 of the housing tube 21 or of a plurality of tubes located side by side. Disassembly of the contact sleeve 12 in the direction of the arrow 22' indicated in FIG. 4 is prevented; the contact sleeve 12 is locked by means of its shoulder 16 behind the step 27 of the ramp 26. The contact sleeve 12 is thus correctly locked in its final e assembled position in the housing 20 of the male part 10.

The male part 10 can now be coupled to the female part 40, which can be seen in FIG. 4 by the dashed-dotted illustration 40' of the female part. The front section 11, which has already been mentioned initially, of the male part 10 comes to rest in the receptacle 41 of the coupled female part 40'. The contact pin passes through the through-hole 32 at the end of the cap, which is located in the pushed-in position 30', into the coupling position 42, which is likewise illustrated by dashed-dotted lines in FIG. 4, in the interior of the contact sleeve 12 and ensures that electrical contact is made correctly there. The female part 40 has a radially projecting stud 54, which can be seen in FIG. 4 and, in its coupled position 54', which is likewise indicated by dashed-dotted lines in FIG. 4, moves over an inclined ramp 56 into an opening 55 of a sprung bracket 57 which is integrally formed on the housing 20. There is also mechanical locking between the male part 10 and the female part located in the coupled position 40'. An electrical continuity check between the contact sleeve 12 and the mated contact pin 42' using electrical test equipment confirms that the components of the male part 10 have been assembled correctly.

Coding means are provided for assembly of the male part such that it cannot rotate on the one hand, and for correct coupling of the male part 10 and female part 40. Thus, according to FIG. 5, the housing 20 has coding grooves 58 at specific points, which interact with complementary coding ribs 59, which are indicated by dashed lines in FIG. 7, in the interior of the cap 30. As can be seen in FIG. 5, the coding grooves 58 are located between adjacent housing tubes 21. In addition, axial cutouts 60 can be provided, according to FIGS. 5 and 7, both in the cap 30 and in the housing 20, which axial cutouts 60 ensure that the male part 10 is correctly coupled to the female part 40 such that it cannot rotate. Complementary axial webs or axial pins, which are not shown in detail and move into these axial cutouts 60 when the socket is coupled 40', are provided for this purpose in the receptacle 41 of the socket.

FIG. 8 shows the case when a male part 10 and a female part 40' are coupled where, in the male part 10, the contact sleeve 12' which is shown has accidentally been pushed in a rotated position, contrary to the preceding description. If the contact sleeve 12' is inserted twisted through one hundred eighty degrees with respect to the nominal case, the radially projecting tab 17 points toward the lower tubular wall 23 and not, as in the case of the correct position in FIGS. 1 to 4, toward the upper tubular wall 28. In consequence, the tab 17 can also not move into the longitudinal slot 29 which is located in the upper tubular wall 28, but abuts, at the transition point between the wide hole region and the narrow hole region, mentioned initially, of the housing tube 21 against a step surface 61 which stops the further insertion assembly 22 of the contact sleeve 12'. The said shoulder 16 of the contact sleeve 12' faces the upper cap side wall part 33 and, in consequence, is not able to carry out the described outward-directed pivoting of the tongue 25 in the direction in FIG. 2. Even if the incorrect installation of the contact sleeve 12' has been overlooked in the visual inspection already described, the incorrect assembly of the male part 10 can be detected correctly using the subsequent electrical inspection which is now still possible, as can easily be detected.

As has already been stressed, as can be seen from FIG. 8, the contact sleeve 12' cannot reach the full installation depth in the case of FIG. 8 as a result of the stop effect between the tab 17 and the step surface 61 of the housing 20. This can be seen from the coupled position 40' of the female part in FIG. 8, where the mated contact pin 42' comes to rest at an axial distance in front of the end of the incorrectly assembled contact sleeve 12'. In consequence, electrical contact is not made. The contact gap 51 can be unambiguously deduced by means of a voltage, which is applied via electrical equipment, between the incorrectly installed contact sleeve 12' and the mated contact pin 42', which does not initiate any current flow. Incorrect assembly of the male part 10 is thus detected and this defect can be rectified.

What is claimed:

1. An electrical connection, in particular for motor vehicles, having a male part (10) and having a female part (40), whose female part (40) has a receptacle (41) which is complementary to the insertion profile (11) of the male part (10) and has at least one contact pin (42), which, in the coupled case (42') moves into the male part (10) and makes contact there with a contact sleeve (12) assigned to it, and whose male part (10) comprises a housing (20) having at least one tubular channel (21) for the contact sleeve (12), and an end plate having at least one through-hole (32) for the contact pin (42) of the female part (40), the end plate is connected to the housing (20) by means of complementary longitudinal guide elements and is displaceable between at least two axial positions with respect to the housing (20), namely on the one hand, an extended position which allows axial insertion assembly (22) of the contact sleeve (12) in the housing (20) until a sprung tongue which is located on the housing (20) snaps behind a shoulder (16) on the contact sleeve (12) which is located in a defined assembly position, and, on the other hand, a pushed-in position in which the longitudinal guide elements which are located on the end plate enter the spring path of the tongue and in consequence lock the contact sleeve (12) in its assembled position, wherein, the end plate is formed by the apex wall (31) of a cap (30) which has a U-shaped profile and whose side walls (33,33',33") are longitudinally guided on the outer contour (44) of the housing (20), the tubular wall (23) of the housing (20) is longitudinally split (24) in one section and forms, between two gaps (24), an outward-sprung tongue (25) which extends in the longitudinal guide region (39) of the cap side wall (33 to 33") on the housing (20), the spring path (48) of the tongue (25) extends radially beyond the outer contour (44) of the housing (20), and, although the cap releases the spring path (48) of the tongue (25) in its extended position (30) by means of its cap side wall (33) facing the tongue (25), it at least partially covers the tongue (25), however, in its pushed-in position (30').

2. The connection as claimed in claim 1, wherein the cap side wall (33) has a window (49) which, in the extended position (30) of the cap, lies over the free end of the tongue (25), (FIG. 3).

3. The connection as claimed in claim 1 or 2, wherein the tongue (25) has an undercut (27) ramp (26) pointing into the tube interior of the housing, on which ramp (26) the shoulder (16) of the contact sleeve (12) moves up during its insertion assembly (22) and, at the same time, presses the tongue (25) into the window opening (49) of the cap, which is located in its extended position (30), until the shoulder (16) engages behind undercut (27) the ramp (26).

4. The connection as claimed in one or more of claims 1 to 3, wherein the cap has an end flange (35) which, in the pushed-in position (30'), presses an annular seal (50), which surrounds the housing (20), against a housing step (18).

5. The connection as claimed in one or more of claims 1 to 4, wherein the tubular wall (28) of the housing (20) has a longitudinal slot (29) into which, for the purpose of push-in assembly such that rotation cannot take place, a tab (17) which is seated on the contact sleeve (12) moves, (FIG. 4).

6. The connection as claimed in claim 5, wherein the longitudinal slot (29) has a closed slot end (19) which, during the push-in assembly (22), forms a stop for the tab (17).

7. Connection as claimed in one or more of claims 1 to 6, wherein coding grooves (58) and ribs (59) are provided in order that the cap (30) is fitted onto the housing (20) such that it cannot rotate.

8. The connection as claimed in one or more of claims 1 to 7, wherein the tubular wall of the housing (20) has a longitudinal cutout (45) which is bounded by an end web (47), and the end web (47) interacts with latching projections (36,37) which are seated on the inner surface of the cap side wall (33") and determine the pushed-out position (30) and/or the pushed-in position (30') of the cap on the housing (20).

* * * * *